US010376080B1

(12) United States Patent
Newland

(10) Patent No.: US 10,376,080 B1
(45) Date of Patent: Aug. 13, 2019

(54) JAR WITH KNIFE SHEATH UNDER LID

(71) Applicant: Ryan P Newland, Barrington, IL (US)

(72) Inventor: Ryan P Newland, Barrington, IL (US)

( * ) Notice: Subject to any disclaimer, the term of this patent is extended or adjusted under 35 U.S.C. 154(b) by 236 days.

(21) Appl. No.: 15/581,308

(22) Filed: Apr. 28, 2017

(51) Int. Cl.

| | |
|---|---|
| ***A45D 33/00*** | (2006.01) |
| ***A47G 19/18*** | (2006.01) |
| ***B65D 23/12*** | (2006.01) |
| ***B65D 43/02*** | (2006.01) |
| ***B65D 1/10*** | (2006.01) |
| ***B65D 85/72*** | (2006.01) |
| ***B65D 51/32*** | (2006.01) |
| ***B26B 29/02*** | (2006.01) |
| ***B26B 3/00*** | (2006.01) |
| ***A47G 21/14*** | (2006.01) |
| ***B65D 51/24*** | (2006.01) |
| ***B65D 77/24*** | (2006.01) |

(52) U.S. Cl.

CPC ..... *A47G 19/186* (2013.01); *A47G 21/145* (2013.01); *B26B 3/00* (2013.01); *B26B 29/025* (2013.01); *B65D 1/10* (2013.01); *B65D 23/12* (2013.01); *B65D 43/0231* (2013.01); *B65D 51/246* (2013.01); *B65D 51/32* (2013.01); *B65D 77/245* (2013.01); *B65D 85/72* (2013.01); *B65D 2543/00537* (2013.01)

(58) Field of Classification Search

CPC .. A47G 19/186; A47G 21/145; B65D 51/246; B65D 77/245

USPC ..... 401/130

See application file for complete search history.

(56) References Cited

U.S. PATENT DOCUMENTS

| | | | |
|---|---|---|---|
| 277,467 | A | 6/1883 | Quillfeldt |
| 317,950 | A | 5/1885 | Lilly |
| 1,017,753 | A | 2/1912 | Harrison |
| 1,021,004 | A | 5/1912 | Sanford |
| 1,327,439 | A | 6/1920 | Lewis |

(Continued)

FOREIGN PATENT DOCUMENTS

| | | | |
|---|---|---|---|
| BE | 1007748 | A3 | 10/1995 |
| DE | 2738960 | A1 | 3/1979 |

(Continued)

OTHER PUBLICATIONS

English Abstract for BE1007748A3.

(Continued)

*Primary Examiner* — Jennifer C Chiang

(74) *Attorney, Agent, or Firm* — Patents and Licensing LLC; Daniel W. Juffernbruch

(57) ABSTRACT

A container holds spreadable food and a handheld spreader. A sheath is configured on an inside surface of the container comprising a top sheath opening at a top of the sheath sized to receive the handheld spreader. The top sheath opening is configured with a same size and shape as a cross-section of the handheld spreader to scrape and clean the handheld spreader when the handheld spreader is slid in the sheath. The sheath has sheath opening near a bottom of the sheath configured to permit flow of liquid therethrough when the handheld spreader is slid in the sheath. The handheld spreader can fixedly attach to a central underside of a screw on lid. The handheld spreader can have a handle area on an end and a spreading surface on an opposing end. The sheath can be integrally formed of the same material as the container.

20 Claims, 6 Drawing Sheets

(56) References Cited

U.S. PATENT DOCUMENTS

| | | | | |
|---|---|---|---|---|
| 1,383,603 | A | 7/1921 | Craig | |
| 1,834,085 | A | 12/1928 | Bloom | |
| 1,875,379 | A | 9/1930 | Holmes | |
| 1,840,662 | A | 1/1932 | Fischer | |
| 2,124,929 | A | 8/1935 | Reid | |
| 2,665,029 | A | 3/1951 | Horrocks | |
| 2,738,900 | A | 2/1954 | Wegner | |
| 2,803,030 | A | 4/1954 | Florio | |
| 2,920,779 | A | 10/1956 | Armitage | |
| 3,022,916 | A | 9/1960 | Spooner | |
| 3,144,152 | A | 8/1964 | Kopp | |
| 3,955,742 | A | 5/1976 | Marshall | |
| 4,001,444 | A | 1/1977 | Clarke | |
| 4,219,283 | A | 8/1980 | Buckley | |
| 4,717,032 | A | 1/1988 | Wu | |
| D302,793 | S | 8/1989 | Yamaguchi | |
| 5,236,022 | A | 8/1993 | Husted | |
| 5,251,774 | A | 10/1993 | Engle | |
| 5,291,992 | A | 3/1994 | Olvetti | |
| 5,586,676 | A | 12/1996 | Lynd | |
| 5,738,242 | A | 4/1998 | Paris | |
| 6,578,725 | B2 | 6/2003 | Delman | |
| 6,772,904 | B1 | 8/2004 | Gilliam | |
| 7,770,745 | B2 | 8/2010 | Weissmann | |
| 8,740,012 | B2 | 6/2014 | Ekkert | |
| 2009/0261113 | A1 | 10/2009 | Miota | |
| 2009/0293898 | A1 | 12/2009 | Young | |
| 2009/0321478 | A1 | 12/2009 | Juteau | |
| 2012/0285845 | A1* | 11/2012 | Jackson | A47G 19/186 206/223 |
| 2018/0192802 | A1* | 7/2018 | Johnson | A47G 21/145 |

FOREIGN PATENT DOCUMENTS

| | | | |
|---|---|---|---|
| DE | 3629718 | A1 | 3/1988 |
| DE | 3900335 | A1 | 8/1989 |
| DE | 3940429 | A1 | 6/1991 |
| DE | 19718043 | A1 | 11/1998 |
| DE | 19718310 | A1 | 11/1998 |
| DE | 29817273 | U1 | 12/1998 |
| DE | 19940739 | A1 | 12/2000 |
| EP | 0922650 | A1 | 6/1999 |
| EP | 0922650 | A1 | 8/2006 |
| JP | 2003230475 | A | 8/2003 |
| WO | WO2000048721 | A1 | 8/2000 |
| WO | WO2009072874 | A1 | 6/2009 |
| WO | WO2013104780 | A1 | 7/2013 |

OTHER PUBLICATIONS

English Abstract for DE2738960A1.
English Abstract for DE3629718A1.
English Abstract for DE3900335A1.
English Abstract for DE3940429A1.
English Abstract for DE19718043A1.
English Abstract for DE19718310A1.
English Abstract for DE19940739A1.
English Abstract for DE29817273U1.
English Abstract for JP2003230475A.
English Abstract for EP0922650A1.
English Translation for WO2000048721A1.

* cited by examiner

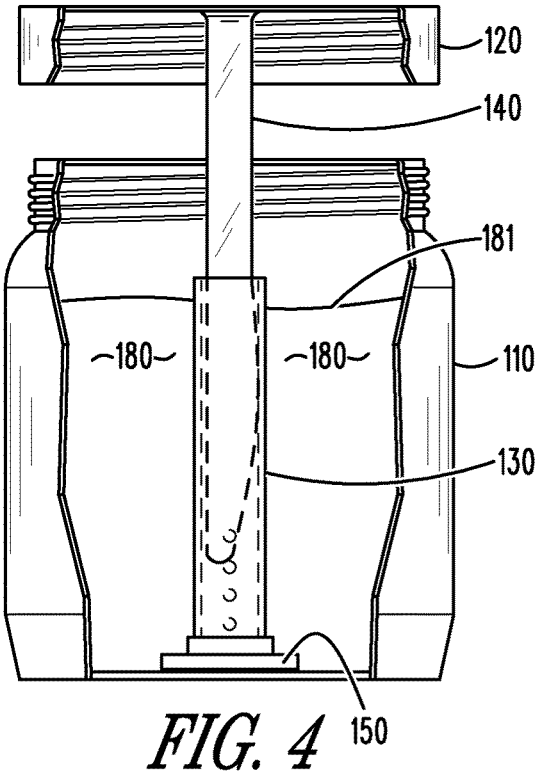
FIG. 4
FIG. 5
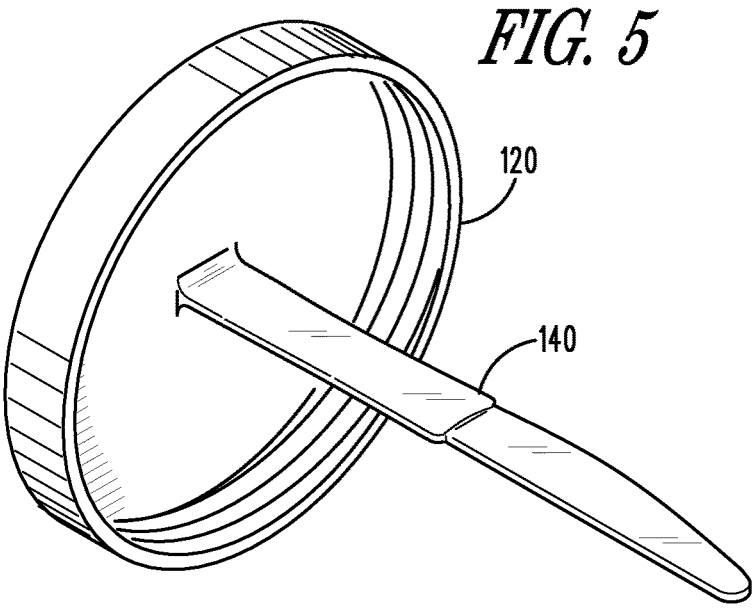

JAR WITH KNIFE SHEATH UNDER LID

BACKGROUND OF THE INVENTIONS

1. Technical Field

The present inventions relate to containers and, more particularly, relate to jars capable of holding utensils.

2. Description of the Related Art

Typically food jars are stored in a kitchen refrigerator and knifes are stored in a kitchen drawer. Assembling food such as sandwiches require taking a knife from a drawer to spread the food from the jar on bread. Then the knife needs to be washed and returned to the drawer. A next food assembly at another time repeats this process.

What is needed is an apparatus for a more streamlined way of assembling food such as making a sandwich.

BRIEF DESCRIPTION OF THE DRAWINGS

The present inventions are illustrated by way of example and are not limited by the accompanying figures, in which like references indicate similar elements. Elements in the figures are illustrated for simplicity and clarity and have not necessarily been drawn to scale.

The details of the preferred embodiments will be more readily understood from the following detailed description when read in conjunction with the accompanying drawings wherein:

FIG. 4 illustrates a side cutaway view of the container with lid and sheath and knife according to the first embodiment of the present inventions;

FIG. 5 illustrates a perspective view of lid and knife according to the first embodiment of the present inventions;

DETAILED DESCRIPTION OF THE PREFERRED EMBODIMENTS

Figure 1:
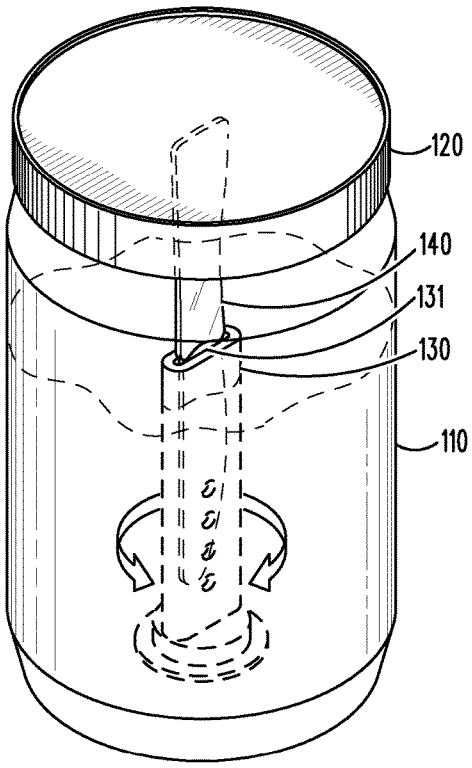
FIGS. 1-3 illustrate perspective views of a container with lid and sheath and knife according to a first embodiment of the present inventions.
Figure 3:
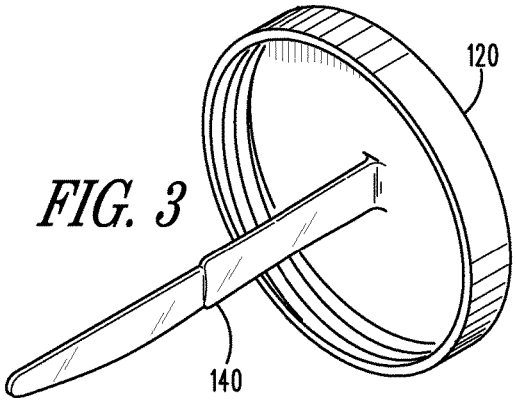
Figure 2:
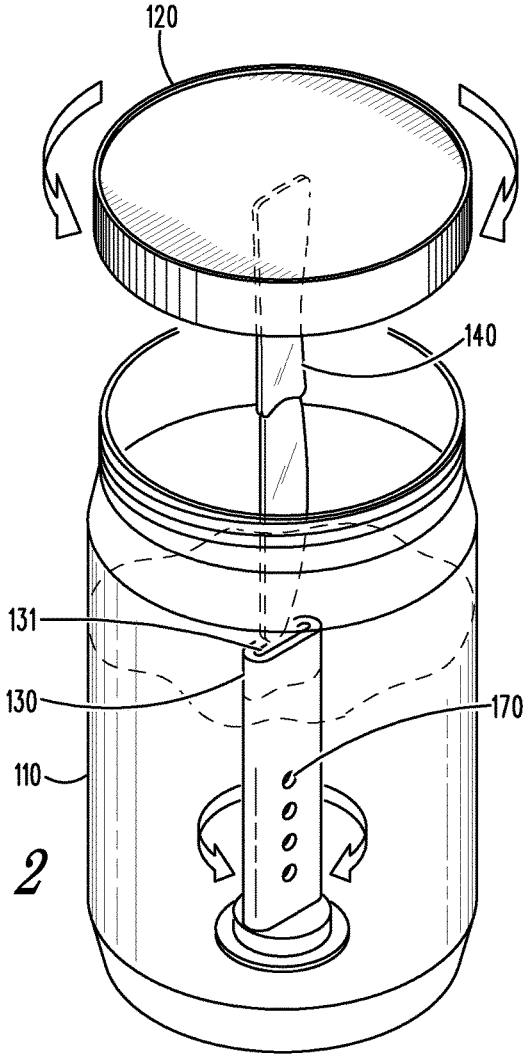

FIGS. 1-3 illustrate perspective views of a container 110 such as a jar with lid 120 and sheath 130 and knife 140 according to a first embodiment of the present inventions. In this first embodiment, a bottom end of the sheath 130 rotatably attaches to a central bottom 150 of the jar container 110 and the knife 140 is fixedly attached to a central underside of the lid 120. The jar container 110 holds spreadable food and a handheld spreader such as a knife 140 or other utensil. One or more sides of the container 110 and a bottom attached to the sides define an inside surface with a top opening. The sheath 130 is configured on the inside surface of the container 110. The sheath 130 has a top sheath 130 opening at a top of the sheath 130 sized to receive the handheld spreader knife 140.

In the first embodiment the top sheath opening 131 is configured with a same size and shape as a cross-section of the handheld spreader knife 140 to scrape and clean the handheld spreader knife 140 when the handheld spreader knife 140 is slid in the sheath 130. In the first embodiment the sheath 130 has one or more secondary sheath openings 170 near a bottom of the sheath 130 configured to permit flow of liquid therethrough when the handheld spreader knife 140 is slid in the sheath 130, wherein the liquid comprises at least one or both of the spreadable food and air. In the first embodiment the sheath 130 is configured on the bottom of the container 110.

In the first embodiment the container 110 has a lid 120 configured to meet with the top opening of the container 110. While the illustrated lid 120 screws on, the lid 120 can in alternate embodiments attach other ways such as snapping onto the jar container 110. The screw-on lid 120 in the first embodiment illustrated has the handheld spreader knife 140 fixedly attached to an underside of a center of the screw on lid 120. In these certain illustrated embodiments the sheath 130 rotatably attaches to a center of the bottom of the container 110. In the first embodiment illustrated the handheld spreader knife 140 comprises a spreading surface opposite the lid 120.

In the first embodiment illustrated the handheld spreader knife 140 can have a detachable coupler at the underside of the center of the screw on lid 120.

FIG. 4 illustrates a side cutaway view of the container 110 with lid 120 and sheath 130 and knife 140 according to the first embodiment of the present inventions.

In one alternate construction the sheath 130 can snap onto a flange mounded into a glass or plastic bottom 150 of the jar container 110. The sheath 130 can also be rotatably coupled. Such will be illustrated later in an example of the close up cutaway view of FIG. 9 which also illustrates detail of how to construct the interface between the sheath 130 and the jar container 110 bottom for the first embodiment. In the embodiment of FIG. 4, the contents 180 of the jar container 110 reach a level 181 near the top of the sheath 130. The contents 180 can be a foodstuff such as mayonnaise, jelly, or peanut butter.

FIG. 5 illustrates a perspective view of lid 120 and knife 140 according to the first embodiment of the present inventions.

Figure 6:
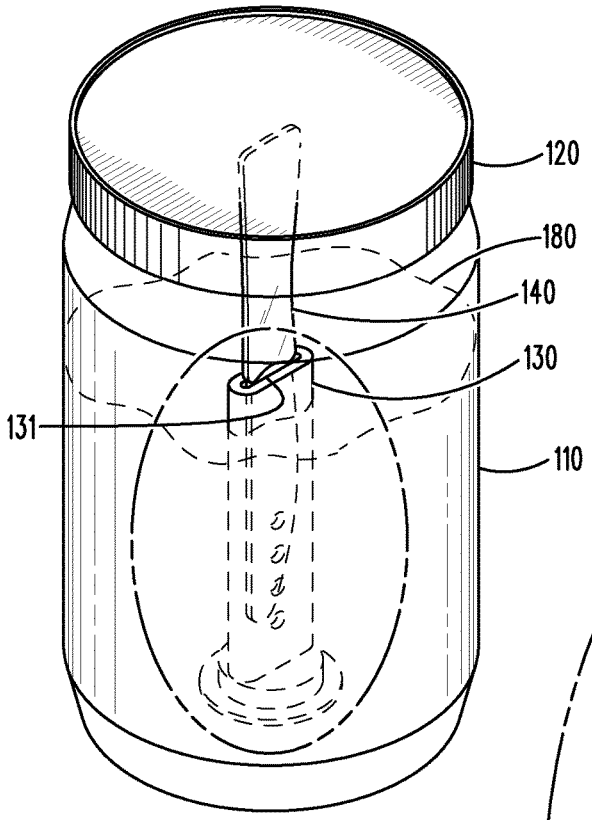
FIG. 6 illustrates a perspective view of a container with lid and sheath and knife according to the first embodiment of the present inventions.

FIG. 6 illustrates a perspective view of a container 310 with lid 320 and sheath 330 and knife 340 according to the first embodiment of the present inventions. The sheath 130 attaches to a bottom of the jar container 110 and the knife 140 is attached at a top to a central underside of the lid 120. A level 181 of the foodstuff 180 or other contents of the jar container 110 does not extend above the top of the sheath 130. The jar container 110 holds spreadable food. One or more sides of the container 110 and a bottom attached to the sides define an inside surface with a top opening. The sheath 130 is configured on the inside surface of the container 110.

The sheath 130 has a top sheath opening 131 at a top of the sheath 130 sized to receive the handheld spreader or knife 140.

Figure 7:
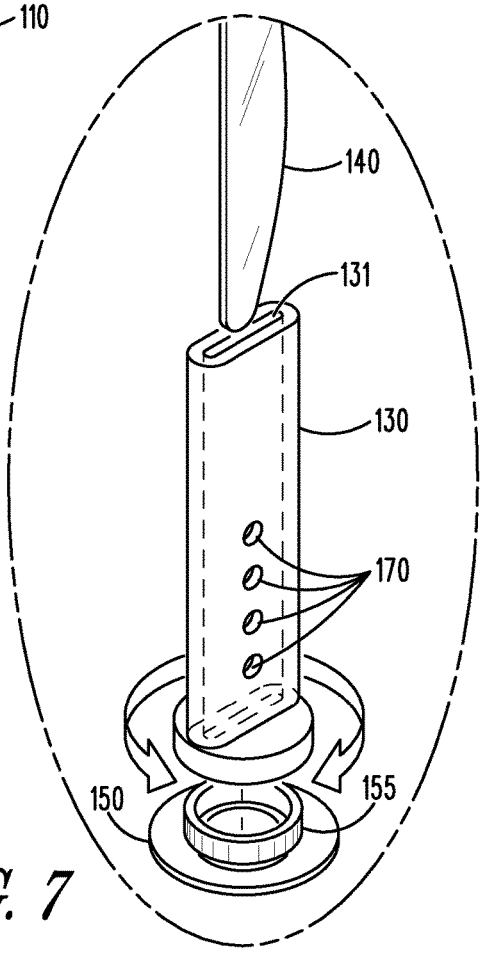
FIG. 7 illustrates a close up cutaway view of one alternate construction of the how the sheath attaches to the bottom of the jar according to the first embodiment of the present inventions.

FIG. 7 illustrates a close up cutaway view of one alternate construction of the how the sheath 130 attaches to the bottom 150 of the jar container 110 according to the first embodiment of the present inventions. The sheath 130 can snap onto a flange 155 mounded into a glass or plastic bottom 150 of the jar container 110. The sheath 130 can also be rotatably coupled. While rotatably coupling is very useful in the first embodiment, the third embodiment may also benefit from rotatably coupling of the sheath 130 or the jar container 110. While in the first embodiment the sheath 130 is rotatably attached to the bottom of the jar container 110, in the upcoming second embodiment, the sheath 130 should be fixedly attached to the bottom of the jar container 110. FIG. 7 also illustrates detail of how to construct the interface between the sheath 130 and the jar container 110 bottom for the upcoming third embodiment. One or more secondary sheath openings 170 near a bottom of the sheath 130 are configured to permit flow of liquid therethrough when the handheld spreader knife 140 is slid in the sheath 130, wherein the liquid comprises at least one or both of the spreadable food and air.

Figure 8:
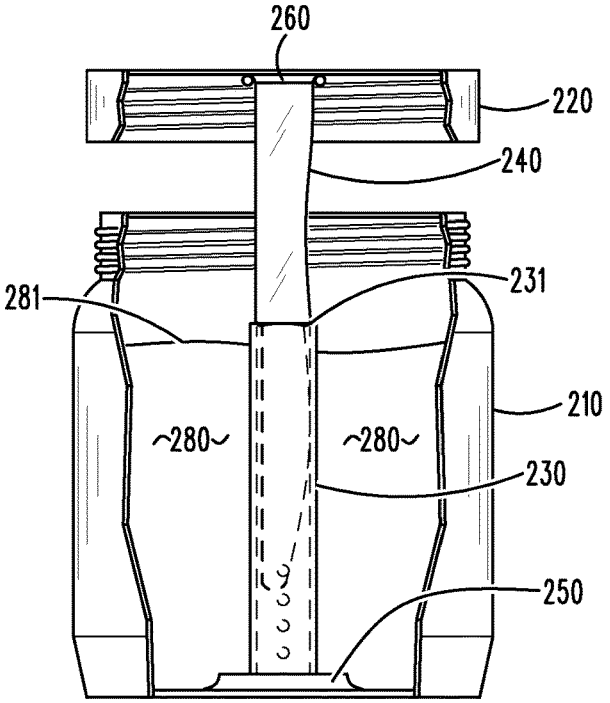
FIG. 8 illustrates a side cutaway view of the container with lid and sheath and knife according to a second embodiment of the present inventions.

FIG. 8 illustrates a side cutaway view of the container 210 with lid 120 220 and sheath 230 and knife 240 according to a second embodiment of the present inventions. In the second embodiment, the knife 240 rotatably attaches to a central underside 260 of the lid 220 and the sheath 230 is fixedly attached to a center bottom 250 of the jar container 210. The jar container holds spreadable food and a handheld spreader such as a knife 240 or other utensil. One or more sides of the container 210 and a bottom attached to the sides define an inside surface with a top opening. The sheath 230 is configured on the inside surface of the container 210. The sheath 230 has a top sheath opening 231 at a top of the sheath 230 sized to receive the handheld spreader knife 240. In the second embodiment of FIG. 8, the contents 280 of the jar container 210 reach a level 281 near the top of the sheath 230. The contents can be a foodstuff such as mayonnaise, jelly, or peanut butter.

In the second embodiment the top sheath 230 opening is configured with a same size and shape as a cross-section of the handheld spreader knife 240 to scrape and clean the handheld spreader knife 240 when the handheld spreader knife 240 is slid in the sheath 230. In the second embodiment the sheath 230 comprises a secondary sheath 231 opening near a bottom of the sheath 230 configured to permit flow of liquid therethrough when the handheld spreader knife 240 is slid in the sheath 230, wherein the liquid comprises at least one or both of the spreadable food and air. In the second embodiment the sheath 230 is configured rotatably attached on the bottom of the container 210.

In the second embodiment the container 210 has a lid 220 configured to meet with the top opening of the container 210. While the illustrated lid 220 screws on, the lid 220 can in alternate embodiments attach other ways such as snapping onto the jar container 210.

The screw-on lid 220 in the second embodiment illustrated has the handheld spreader knife 240 rotatably attached to an underside of a center of the screw on lid 220. In the second embodiment the sheath 230 is fixedly attached to a center of the bottom of the container 210. In the second embodiment the handheld spreader knife 240 comprises a spreading surface opposite the lid 220.

In the second embodiment illustrated the handheld spreader knife 240 can optionally have a detachable coupler at the underside of the center of the screw on lid 220.

Figure 9:
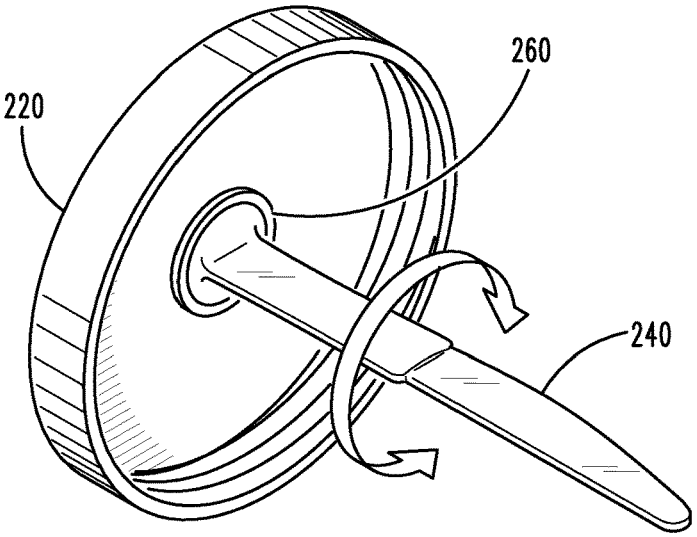
FIG. 9 illustrates a perspective view of lid and knife according to the second embodiment of the present inventions.

FIG. 9 illustrates a perspective view of lid 220 and knife 240 according to the second embodiment of the present inventions. In the second embodiment, the knife 240 rotatably attaches to a central underside 260 of the lid 220.

Figure 10:
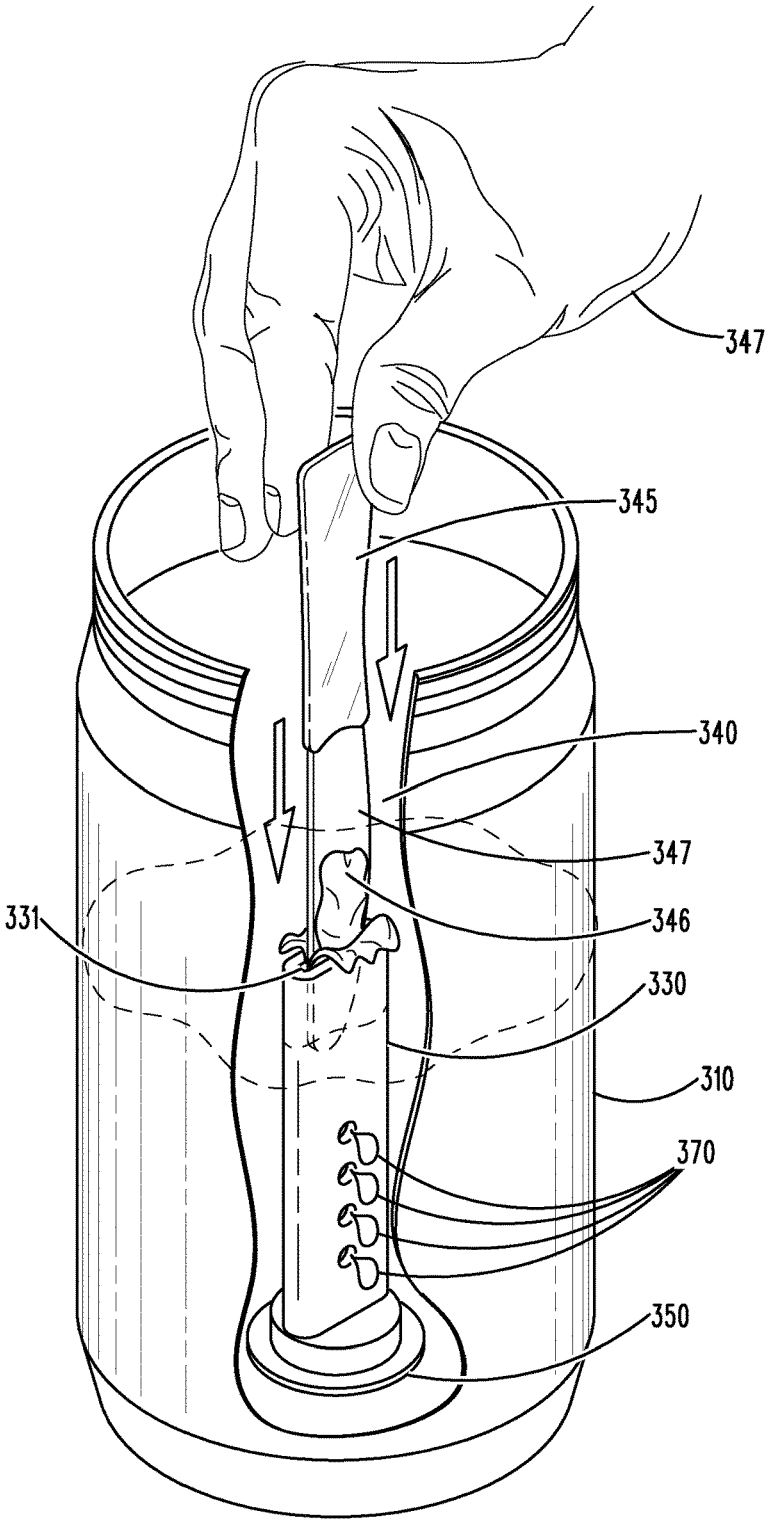
FIG. 10 illustrates a perspective view of a container with sheath and knife with handle grasped by hand according to a third embodiment of the present inventions.

FIG. 10 illustrates a perspective view of a container 310 with sheath 330 and knife 340 with handle grasped by hand according to a third embodiment of the present inventions. In this third embodiment, the sheath 330 attaches to a bottom of the jar container 310 and the knife 340 has a handle 345 stowed inside the jar container 310. The handle 345 is loose for grasping by hand and not affixed. A level 380 of the foodstuff or other contents of the jar container 310 does not extend above the top of the sheath 330. This permits the hand 347 grasping of the handle end of the knife 340. The jar container 310 holds spreadable food and a handheld spreader knife 340 such as a knife 340 or other utensil. One or more sides of the container 310 and a bottom attached to the sides define an inside surface with a top opening. The sheath 330 is configured on the inside surface of the container 310. The sheath 330 has a top sheath opening 331 at a top of the sheath 330 sized to receive the handheld spreader knife 340.

The sheath 330 is attached to the bottom 350 of the jar container 310 and the knife 340 has the handle 345 stowed inside the jar container 310. The handle 345 is loose for grasping by a hand 347 and not affixed. A level 380 of the foodstuff or other contents of the jar container 310 does not extend above the top of the sheath 330. This permits the hand grasping of the handle end of the knife 340.

In the third embodiment the top sheath opening 331 is configured with a same size and shape as a cross-section of the handheld spreader knife 340 to scrape and clean the handheld spreader knife 340 when the handheld spreader knife 340 is slid in the sheath 330. Excess foodstuff or contents 346 are removed from a blade end 347 of the knife 340 when the top sheath opening 331 scrapes and cleans the knife 340. In the third embodiment the sheath 330 comprises secondary sheath openings 370 near a bottom of the sheath 330 configured to permit flow of liquid therethrough when the handheld spreader knife 340 is slid in the sheath 330, wherein the liquid comprises at least one or both of the spreadable food and air. In the third embodiment the sheath 330 is configured on the bottom 350 of the container 310.

In the third embodiment the container 310 has a lid 320 configured to meet with the top opening of the container 310. While the illustrated lid 320 and jar container 310 has threads 390 configured to screw together, the lid 320 can in alternate embodiments attach other ways such as snapping onto the jar container 310.

In the third embodiment the handheld spreader knife 340 has a handle area 345 on an end and a spreading surface 347 on an opposing end. The spreading surface of the handheld spreader knife 340 further comprises a blade on an edge of the spreading surface.

Figure 11:
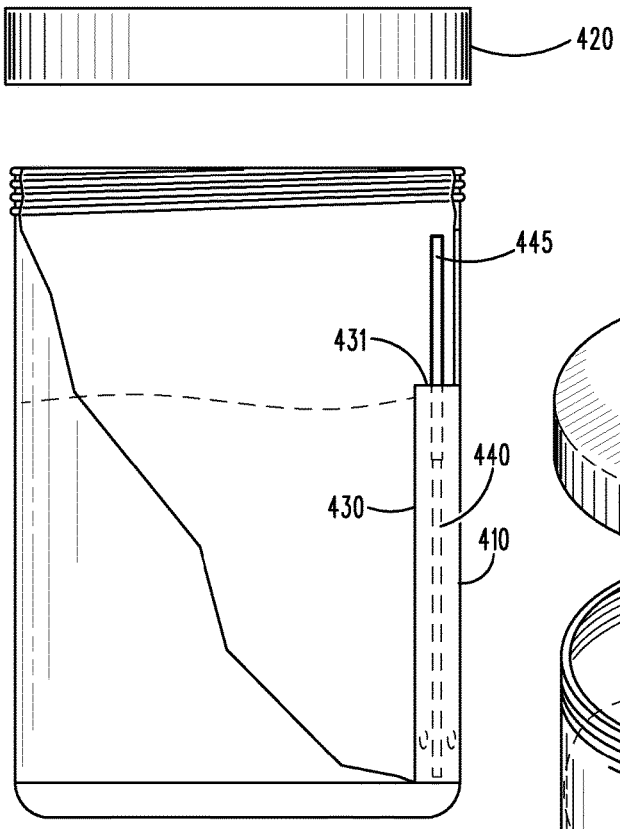
FIG. 11 illustrates a side view of a container with sheath and knife according to a fourth embodiment of the present inventions.

FIG. 11 illustrates a side view of a container 410 with an integral sheath 430 and knife 440 according to a fourth embodiment of the present inventions. In this fourth embodiment, the sheath 430 is integrally formed in a side of the jar container 410 and the knife 440 has a handle 445 stowed inside the jar container 410. The handle 445 is loose for grasping by hand and not affixed. A level of the foodstuff or other contents of the jar container 410 does not extend above the top of the sheath 430. This permits the hand grasping of the handle end of the knife 440. The jar container 410 holds spreadable food and a handheld spreader such as a knife 440 or other utensil. One or more sides of the container 410 and a bottom attached to the sides define an inside surface with a top opening. The sheath 430 is configured on the inside surface of the container 410. The sheath 430 has a top sheath opening 431 at a top of the sheath 430 sized to receive the handheld spreader knife 440. The top sheath opening 431 is configured with a same size and shape as a cross-section of the handheld spreader knife 440 to scrape and clean the handheld spreader knife 440 when the handheld spreader knife 440 is slid in the sheath 430.

In the fourth embodiment the sheath 430 is integrally formed of the same material as the container 410. In the fourth embodiment the sheath 430 is configured on at least one of the sides of the container 410. In the fourth embodiment illustrated sheath 430 can be molded or integrally formed into a side of the jar container 410, such as a plastic molded jar.

In the fourth embodiment the sheath 430 can have a secondary sheath opening near a bottom of the sheath 430 configured to permit flow of liquid therethrough when the handheld spreader knife 440 is slid in the sheath 430, wherein the liquid comprises at least one or both of the spreadable food and air.

Figure 12:
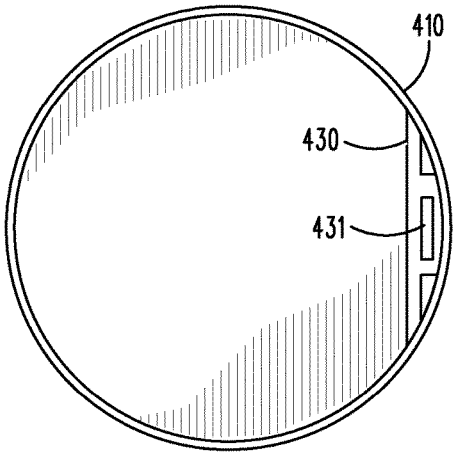
FIG. 12 illustrates a top view of the container according to the fourth embodiment of the present inventions.

FIG. 12 illustrates a top view of the container 410 with the integral sheath 430 according to the fourth embodiment of the present inventions. The sheath 430 is integrally formed in a side of the jar container 410. The sheath 430 has a top sheath opening 431 at a top of the sheath 430 sized to receive the handheld spreader knife. The top sheath opening 431 is configured with a same size and shape as a cross-section of the handheld spreader knife to scrape and clean the handheld spreader knife when the handheld spreader knife is slid in the sheath 430. The top sheath opening 431 is configured with a same size and shape as a cross-section of the handheld spreader knife 440 to scrape and clean the handheld spreader knife 440 when the handheld spreader knife 440 is slid in the sheath 430.

Figure 13:
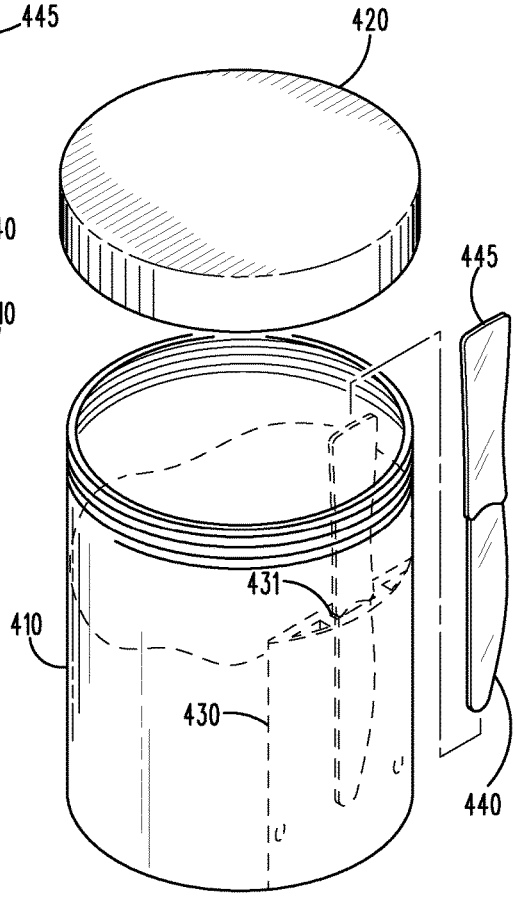
FIG. 13 illustrates a perspective view of a container with lid and sheath and knife according to the fourth embodiment of the present inventions.

FIG. 13 illustrates a perspective view of the container 410 with lid 420 and integral sheath 430 and knife 440 according to the fourth embodiment of the present inventions. The sheath 430 is integrally formed in a side of the jar container 410 and the knife 440 has a handle 445 stowed inside the jar container 410. The handle 445 is loose for grasping by hand and not affixed. A level of the foodstuff or other contents of the jar container 410 does not extend above the top of the sheath 430. This permits the hand grasping of the handle end of the knife 440. The jar container 410 holds spreadable food and a handheld spreader such as a knife 440 or other utensil. One or more sides of the container 410 and a bottom attached to the sides define an inside surface with a top opening. The sheath 430 is configured on the inside surface of the container 310. The sheath 430 has a top sheath opening 431 at a top of the sheath 430 sized to receive the handheld spreader knife 440. The top sheath opening 431 is configured with a same size and shape as a cross-section of the handheld spreader knife 440 to scrape and clean the handheld spreader knife 440 when the handheld spreader knife 440 is slid in the sheath 430.

In the fourth embodiment the handheld spreader knife 440 has a handle area on an end and a spreading surface on an opposing end. The spreading surface of the handheld spreader knife 440 further comprises a blade on an edge of the spreading surface.

In the fourth embodiment the container 410 has a lid 420 configured to meet with the top opening of the container 410. While the illustrated lid 420 screws on, the lid 420 can in alternate embodiments attach other ways such as snapping onto the jar container 410.

Unless stated otherwise, terms such as "first" and "second" are used to arbitrarily distinguish between the elements such terms describe. Thus, these terms are not necessarily intended to indicate temporal or other prioritization of such elements.

Although the inventions have been described and illustrated in the above description and drawings, it is understood that this description is by example only, and that numerous changes and modifications can be made by those skilled in the art without departing from the true spirit and scope of the inventions. Although the examples in the drawings depict only example constructions and embodiments, alternate embodiments are available given the teachings of the present patent disclosure.

What is claimed is:

1. A container for holding spreadable food and a handheld spreader, comprising:
   - one or more container sides and a bottom attached to the sides defining an inside surface with a top opening; and
   - a sheath configured on the inside surface of the container, the sheath comprising a top sheath opening at a top of the sheath sized to receive the handheld spreader; and
   - a lid configured to meet with the top opening of the container, wherein the lid comprises a screw-on lid with an underside;
   - wherein the handheld spreader rotatably attaches to the underside of the screw on lid, wherein the rotatable attachment rotates infinitely;
   - wherein the sheath attaches to at least the bottom of the container; and
   - wherein the handheld spreader comprises a spreading surface opposite the lid.

2. A container for holding spreadable food and a handheld spreader according to claim 1, wherein the handheld spreader has a substantially flat shape; and wherein the top sheath opening is a slit configured with a same size and shape as a cross-section of the substantially flat shape of the handheld spreader to scrape and clean the handheld spreader when the handheld spreader is slid into the slit.

3. A container for holding spreadable food and a handheld spreader according to claim 2, wherein the sheath further comprises a secondary sheath opening near a bottom of the sheath configured to permit flow of liquid therethrough into an interior of the container when the handheld spreader is slid in the sheath, wherein the liquid comprises at least one or both of the spreadable food and air.

4. A container for holding spreadable food and a handheld spreader according to claim 1, wherein the sheath is integrally formed of the same material as the container.

5. A container for holding spreadable food and a handheld spreader according to claim 1, wherein the spreading surface of the handheld spreader comprises a blade on an edge of the spreading surface.

6. A container for holding spreadable food and a handheld spreader according to claim 1,
   - wherein the handheld spreader attaches at a center of the underside of the screw on lid; and
   - wherein the sheath fixedly attaches at a center of the bottom of the container.

7. A container for holding spreadable food and a handheld spreader according to claim 1, wherein the sheath fixedly attaches to the bottom of the container.

8. A container for holding spreadable food and a handheld spreader, comprising:

one or more container sides and a bottom attached to the sides defining an inside surface with a top opening; and a sheath configured on the inside surface of the container, the sheath comprising a top sheath opening at a top of the sheath sized to receive the handheld spreader; and a lid configured to meet with the top opening of the container, wherein the lid comprises a screw-on lid;

wherein the handheld spreader fixedly attaches to an underside of a center of the screw on lid;

wherein the sheath rotatably attaches to a center of the bottom of the container; and wherein the handheld spreader comprises a spreading surface opposite the lid.

9. A container for holding spreadable food and a handheld spreader according to claim 8, wherein the lid and the top opening of the container each comprise threads configured to screw together.

10. A container for holding spreadable food and a handheld spreader according to claim 8, wherein the handheld spreader comprises a detachable coupler at the underside of the center of the screw on lid.

11. A container for holding spreadable food and a handheld spreader according to claim 10, wherein the sheath further comprises a secondary sheath opening near a bottom of the sheath configured to permit flow of liquid therethrough when the handheld spreader is slid in the sheath, wherein the liquid comprises at least one or both of the spreadable food and air.

12. A container for holding spreadable food and a handheld spreader according to claim 10, wherein the handheld spreader comprises a handle area on an end and a spreading surface on an opposing end.

13. A container for holding spreadable food and a handheld spreader according to claim 8, wherein the handheld spreader has a substantially flat shape; and wherein the wherein the top sheath opening is a sheath configured with a same size and shape as a cross-section of the substantially flat shape of the handheld spreader to scrape and clean the handheld spreader when the handheld spreader is slid in the slit.

14. A container for holding spreadable food and a handheld spreader according to claim 13, wherein the sheath further comprises a secondary sheath opening near a bottom of the sheath configured to permit flow of liquid therethrough into an interior of the container when the handheld spreader is slid into the slit, wherein the liquid comprises at least one or both of the spreadable food and air.

15. A container for holding spreadable food and a handheld spreader, comprising:

a handheld spreader of a substantially flat shape;

one or more container sides and a bottom attached to the sides defining an inside surface with a top opening; and a sheath configured on the inside surface of the container, the sheath comprising a top slit opening at a top of the sheath sized to receive the handheld spreader; and a lid configured to meet with the top opening of the container, wherein the lid comprises a screw-on lid with an underside; and wherein the top slit opening is configured with a same size and shape as a cross-section of the substantially flat shape of the handheld spreader to scrape and clean the handheld spreader when the handheld spreader is slid into the slit.

16. A container for holding spreadable food and a handheld spreader according to claim 15, wherein the sheath further comprises a secondary sheath opening near a bottom of the sheath configured to permit flow of liquid therethrough into an interior of the container when the handheld spreader is slid into the slit, wherein the liquid comprises at least one or both of the spreadable food and air.

17. A container for holding spreadable food and a handheld spreader according to claim 15, wherein the sheath is integrally formed of the same material as the container.

18. A container for holding spreadable food and a handheld spreader according to claim 15, wherein the handheld spreader comprises a handle area on an end and a spreading surface on an opposing end.

19. A container for holding spreadable food and a handheld spreader according to claim 15, wherein the sheath is configured on at least one side of the container.

20. A container for holding spreadable food and a handheld spreader according to claim 15, wherein the sheath is integrally formed into a side of the jar.

* * * * *